US007252532B2

(12) United States Patent
Sato

(10) Patent No.: US 7,252,532 B2
(45) Date of Patent: Aug. 7, 2007

(54) BOARD MOUNT CONNECTOR SUITABLE FOR AUTOMATIC MOUNTING

(75) Inventor: Yukiko Sato, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/509,487

(22) Filed: Aug. 24, 2006

(65) Prior Publication Data

US 2007/0049072 A1 Mar. 1, 2007

(30) Foreign Application Priority Data

Aug. 25, 2005 (JP) ..... 2005-243712

(51) Int. Cl.
*H01R 13/64* (2006.01)

(52) U.S. Cl. ..... 439/374; 439/378; 439/564; 439/607

(58) Field of Classification Search ..... 439/374, 439/378, 564, 567, 569, 607
See application file for complete search history.

(56) References Cited

U.S. PATENT DOCUMENTS 5,147,225 A * 9/1992 Kile et al. ..... 439/680
5,634,810 A * 6/1997 Niitsu et al. ..... 439/378
6,165,015 A * 12/2000 Wu et al. ..... 439/607
6,354,875 B1 * 3/2002 Wu ..... 439/607
6,508,660 B2 * 1/2003 Self ..... 439/374
6,676,449 B2 * 1/2004 Ji et al. ..... 439/607
6,822,466 B1 * 11/2004 Holcombe et al. ..... 324/761
7,086,901 B2 * 8/2006 Zhang ..... 439/607
7,121,885 B2 * 10/2006 Li et al. ..... 439/607

FOREIGN PATENT DOCUMENTS

JP Y-2500036 2/1996
JP Y-2549644 6/1997

* cited by examiner

*Primary Examiner*—Tho D. Ta
(74) *Attorney, Agent, or Firm*—Collard & Roe, P.C.

(57) ABSTRACT

In a connector to be mounted to a board having a pair of first through holes and at least one second through hole, a pair of supporting portions is formed on a housing holding a plurality of contacts arranged in a first direction. Each of the supporting portions protrudes from the housing in a second direction perpendicular to the first direction. First bosses protrude from the supporting portions to be inserted into the first through holes, respectively. At least one second boss is coupled to the housing to be inserted into the at least one second through hole.

25 Claims, 4 Drawing Sheets

BOARD MOUNT CONNECTOR SUITABLE FOR AUTOMATIC MOUNTING

This application claims priority to prior Japanese patent application JP 2005-243712, the disclosure of which is incorporated herein by reference.

BACKGROUND OF THE INVENTION

This invention relates to a connector to be mounted to a board.

As a connector of the type, a connector having a coupling surface parallel to a board and generally high in profile is known (for example, see Japanese Utility Model Registrations Nos. 2500036 and 2549644). The connector comprises a housing made of an insulating material, a number of contacts arranged in parallel to one another at a predetermined pitch and held by the housing, and a shell covering the housing. The housing is provided with an expanded lower portion formed at its lower part. The housing is provided with a boss having a generally rectangular section and formed at a lower center part thereof. The shell is also provided with a plurality of bosses each having a generally rectangular section and formed at a lower part thereof. When these bosses are inserted into through holes of the board, the contacts are connected to contact point patterns of the board. In this state, a mating connector can be connected to the connector.

In order to prevent the connector from falling down when it is mounted to the board, the connector is provided with, for example, the expanded lower portion formed at its bottom. In this case, however, the connector is increased in size and can not meet the demand for a compact structure.

Alternatively, the bosses of the connector may be press-fitted into the through holes of the board. In this case, however, the connector must be pushed so that the bosses are fitted into the through holes. Therefore, depending upon the type of the connector, it is impossible to automatically mount the connector to the board.

Alternatively, the connector is fixed to the board by the use of a hook. In this case, however, the connector is increased in size and can not meet the demand for a compact structure.

SUMMARY OF THE INVENTION

It is therefore an object of this invention to provide a connector suitable to be mounted to a board by an automatic mounting machine.

It is another object of this invention to provide a compact connector.

It is still another object of this invention to provide a connector which is prevented from falling down when it is mounted to a board.

Other objects of the present invention will become clear as the description proceeds.

According to an aspect of the present invention, there is provided a connector to be mounted to a board having a pair of first through holes and at least one second through hole, the connector comprising a housing, a plurality of contacts arranged in a first direction and held by the housing, a pair of supporting portions formed on the housing and protruding from the housing in a second direction perpendicular to the first direction, a pair of first bosses protruding from the supporting portions to be inserted into the first through holes, respectively, and at least one second boss coupled to the housing to be inserted into the at least one second through hole.

DESCRIPTION OF THE PREFERRED EMBODIMENT

Figure 1:
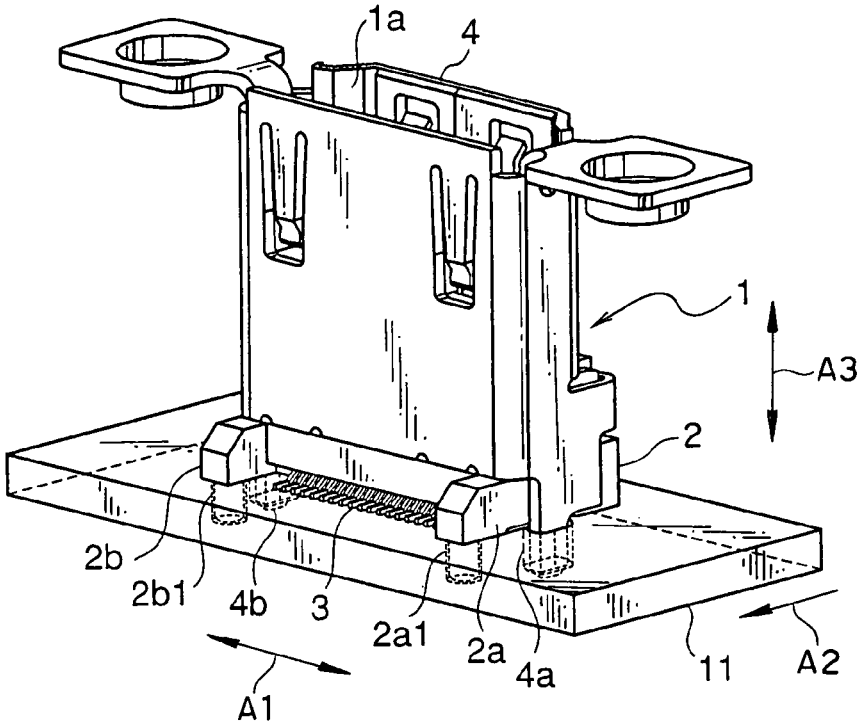
FIG. 1 is a front perspective view of a connector according to an embodiment of this invention when it is mounted to a board.
Figure 2:
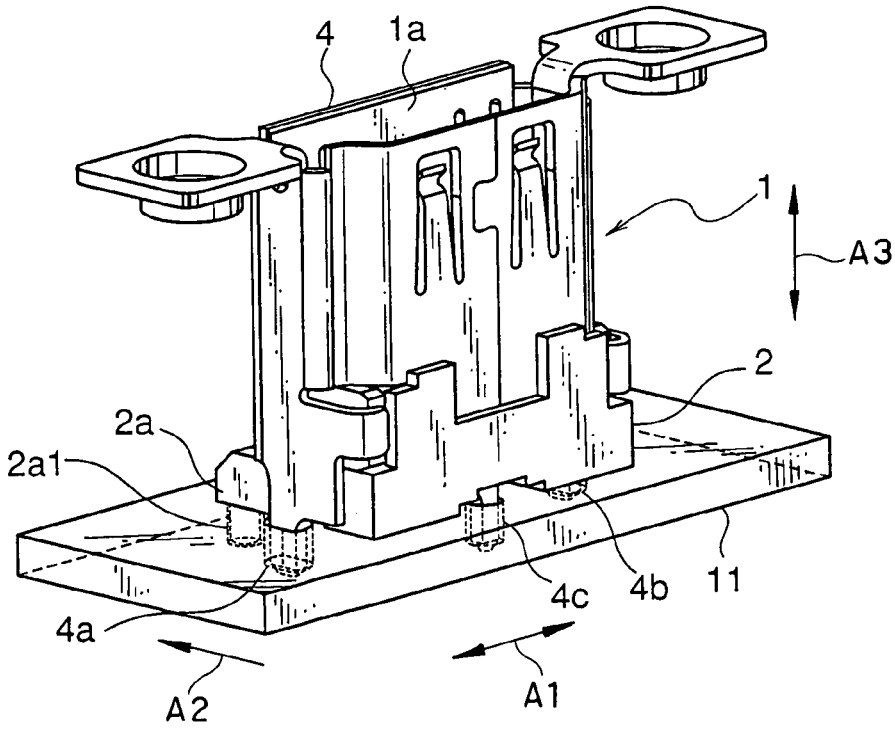
FIG. 2 is a rear perspective view of the connector in FIG. 1 when it is mounted to the board.
Figure 3:
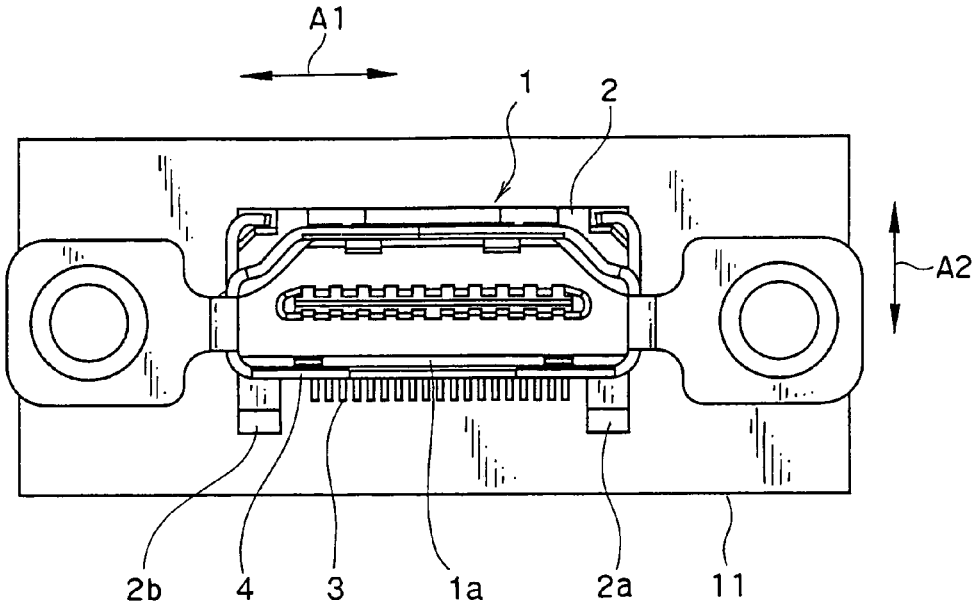
FIG. 3 is a plan view of the connector in FIG. 1 when it is mounted to the board.

Referring to FIGS. 1 through 3, a connector according to an embodiment of this invention will be described.

The connector depicted at 1 in the figure comprises a housing 2 made of an insulating material such as plastic, a number of conductive contacts 3 arranged in parallel to one another at a predetermined pitch in a first direction (left-and-right direction) A1 and held by the housing 2, and a shell 4 made of metal and covering the contacts 3 and the housing 2.

The housing 2 is provided with a pair of, namely, two expanded lower portions 2*a* and 2*b* formed as supporting portions at a lower front part thereof. The expanded lower portions 2*a* and 2*b* are spaced from each other in the first direction A1 and protrude in a second direction (back-and-forth direction) A2 perpendicular to the first direction A1. The expanded lower portions 2*a* and 2*b* are provided with bosses 2*a*1 and 2*b*1 having a circular section and formed on their bottom surfaces, respectively. Each of the bosses 2*a*1 and 2*b*1 will be called a first boss.

The shell 4 is provided with bosses 4*a* and 4*b* formed at a lower center part thereof in the second direction A2. The bosses 4*a* and 4*b* are spaced from each other in the first direction A1 and have a rectangular section. The shell 4 is further provided with a boss 4*c* formed at its lower center part on a rear side. The boss 4*c* has a rectangular section and called a second boss. Each of the bosses 4*a* and 4*b* will be called a third boss.

The connector 1 is mounted to a board 11, for example, by an automatic mounting machine. The contacts 3 are connected to contact point patterns (not shown) of the board 11 by soldering or the like. The connector 1 has a coupling slot 1*a* adapted to receive a connecting portion of a mating connector (not shown). When the mating connector is coupled to the coupling slot 1*a*, the mating connector is contacted with the contacts 3 and electrically connected to the contact point patterns of the board 11 through the contacts 3. It is noted here that the connector 1 has a relatively large height from the board 11 in a third direction (ups-and-downs direction) A3 perpendicular to the first and the second directions A1 and A2.

Figure 4:
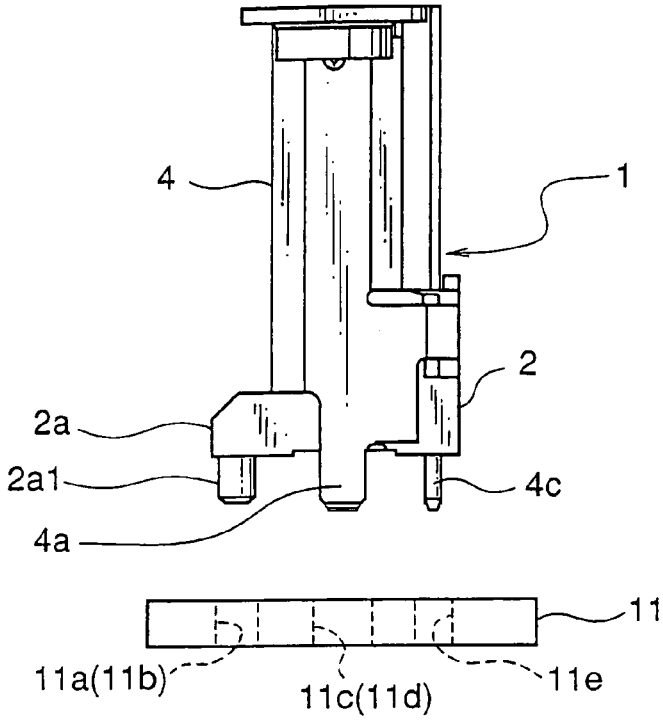
FIG. 4 is a side view of the connector in FIG. 1 when it is separated from the board.
Figure 5:
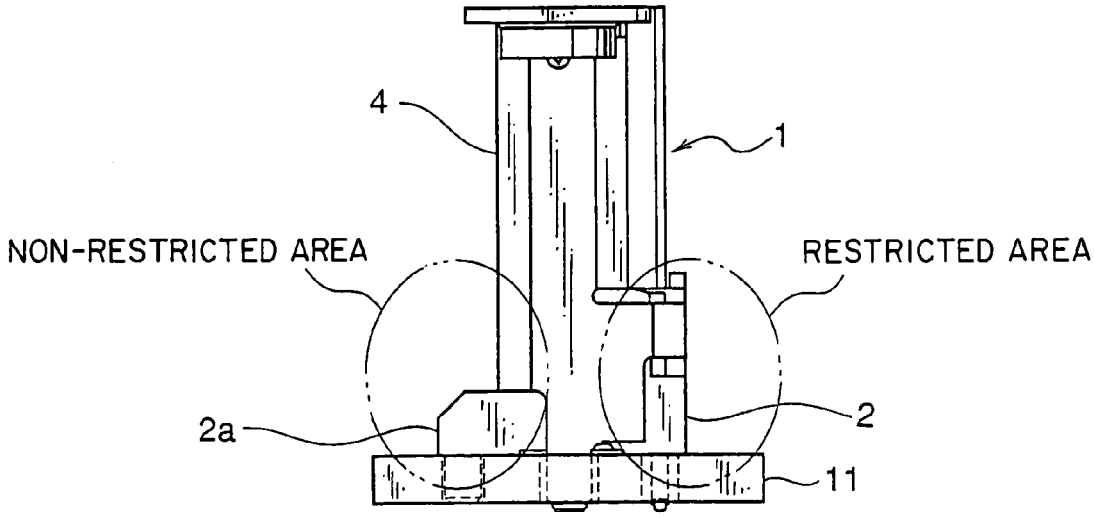
FIG. 5 is a side view of the connector in FIG. 1 when it is mounted to the board.

Referring to FIGS. 4 and 5 in addition, description will be made of a relationship between the connector 1 and the board 11.

The board 11 is provided with a plurality of through holes penetrating the board 11 in a vertical direction. The through holes include two through holes 11*a* and 11*b* having a circular shape, formed at a relatively front part, and spaced from each other in the first direction A1, two through holes 11*c* and 11*b* having a rectangular shape, formed at a center part, and spaced from each other in the first direction A1, and a through hole 11*e* having a rectangular shape and formed at a relatively rear part.

In order to mount the connector 1 to the board 11, the bosses 2*a*1, 2*b*1, 4*a*, 4*b*, and 4*c* of the connector 1 are faced to the through holes 11*a*, 11*b*, 11*c*, 11*d*, and 11*e* of the board 11 as shown in FIG. 4, respectively. Thereafter, the connector 1 is moved down so that the bosses 2*a*1, 2*b*1, 4*a*, 4*b*, and 4*c* are inserted into the through holes 11*a*, 11*b*, 11*c*, 11*d*, and 11*e* of the board 11, respectively. This state is called a provisional mounted state. In the provisional mounted state, the connector 1 is not fixed to the board 11 and can be inclined. Thereafter, the contacts 3 are connected to the contact point patterns of the board 11 and the connector 1 is fixed to the board 11 by appropriate means. Thus, a mounted state illustrated in FIG. 5 is obtained.

Herein, it is assumed that a "non-restricted area" and a "restricted area" are present around the connector 1 where the expanded lower parts can be formed and can not be formed, respectively. In case where the connector 1 is attached to an end portion of the board 11, an upper region above the end portion is the "restricted area" while an upper region of the board 11 on an opposite side of the connector 1 is the "non-restricted area". In case where other electronic parts are mounted to the board 11 to be adjacent to one side of the connector 1, a region where the electronic parts are disposed and its peripheral region are the "restricted area" while an upper region of the board 11 on the other side of the connector 1 is the "non-restricted area". Specifically, in FIG. 5, it is assumed that a region around a front side of the connector 1 is the "non-restricted area" while a region around a rear side of the connector 1 is the "limited area". Therefore, the expanded lower portions 2*a* and 2*b* are formed only on the front side of the connector 1 and no expanded lower portions are formed on the rear side. Thus, the connector 1 can be formed into a relatively compact structure.

Figure 6:
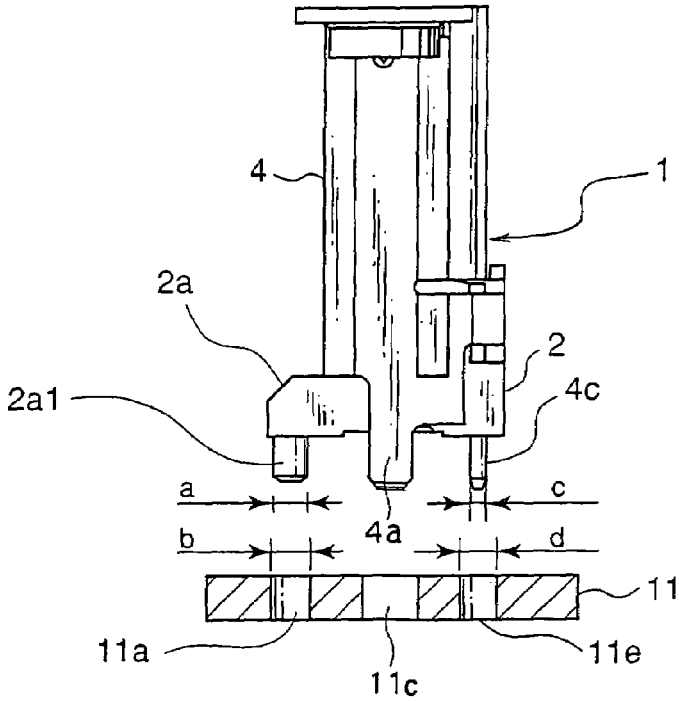
FIG. 6 is a view for describing a dimensional relationship of characteristic parts of the connector and the board.
Figure 7:
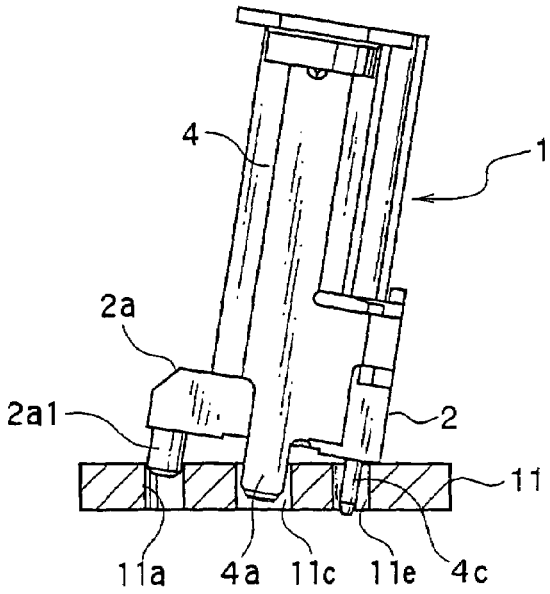
FIG. 7 is a view for describing a state where the connector is inclined at a predetermined angle with respect to the board.

Referring to FIGS. 6 and 7 in addition, description will be made of a dimensional relationship between the bosses 2*a*1, 2*b*1, 4*a*, 4*b*, and 4*c* of the connector 1 and the through holes 11*a*, 11*b*, 11*c*, 11*d*, and 11*e* of the board 11 as well as an effect achieved by the dimensional relationship.

In FIG. 6, the bosses 2*a*1 and 2*b*1 have a same diameter a. The through holes 11*a* and 11*b* have a same diameter b slightly greater than the diameter a. The boss 4*c* has a diameter c. The through hole 11*e* has a diameter d slightly greater than the diameter c. For example, the diameters a through d are determined as follows. However, the diameters b and d may be equal to each other.

a=1.2 mm
b=1.4 mm
c=0.5 mm
d=0.65 mm

The bosses 4*a* and 4*b* are smaller in diameter than the through holes 11*c* and 11*d*. However, the relationship therebetween need not strictly be met because of the following reason. That is, assuming that the connector 1 is inclined in the provisional mounted state as shown in FIG. 7, the bosses 4*a* and 4*b* serve as the center of rotation upon inclination. Therefore, the dimensional relationship between the bosses 4*a* and 4*b* and the through holes 11*c* and 11*d* need not strictly be met.

Since the bosses 2*a*1, 2*b*1, 4*a*, 4*b*, and 4*a* of the connector 1 are smaller in diameter than the through holes 11*a*, 11*b*, 11*c*, 11*d*, and 11*e* of the board 11, respectively, it is easy to insert the bosses into the through holes. Therefore, it is easily possible to mount the connector 1 to the board 11 by the use of the automatic mounting machine.

When the connector 1 is inclined to a predetermined angle in the provisional mounted state as illustrated in FIG. 7, the bosses 2*a*1 and 2*b*1 interfere with inner surfaces of the through holes 11*a* and 11*b* while the boss 4*c* interferes with an inner surface of the through hole 11*e*. As a result, the connector 1 is prevented from being inclined beyond the predetermined angle. Therefore, an operation of connecting the contacts 3 to the contact point patterns of the board 11 is not inhibited.

The bosses 4*a* and 4*b* and the through holes 11*c* and 11*d* are designed so that, even if the connector 1 is inclined to the predetermined angle, the bosses 4*a* and 4*b* do not interfere with inner surfaces of the through holes 11*c* and 11*d*. However, the bosses 4*a* and 4*b* and the through holes 11*c* and 11*d* may be designed so that the bosses 4*a* and 4*b* interfere with the inner surfaces of the through holes 11*c* and 11*d*.

Further, even with the first bosses 2*a*1 and 2*b*1 and the second boss 4*c* without the third bosses 4*a* and 4*b*, the connector 1 can achieve the desired object.

Although this invention has been described in conjunction with the preferred embodiment thereof, this invention may be modified in various other manners. Although a single second boss is illustrated, the housing may be provided with two or more second bosses. In this event, it is a matter of course that the board is added with through holes in response to addition of the second boss.

What is claimed is:

1. A connector to be mounted to a board having a pair of first through holes and at least one second through hole, the connector comprising:

a housing;

a plurality of contacts arranged in a first direction and held by the housing;

a pair of supporting portions formed on the housing and protruding from the housing in a second direction perpendicular to the first direction;

a pair of first bosses protruding from the supporting portions to be inserted into the first through holes, respectively; and at least one second boss coupled to the housing to be inserted into the at least one second through hole, wherein the first bosses are smaller in diameter than the first through holes.

2. The connector according to claim 1, wherein the at least one second boss is smaller in diameter than the at least one second through hole.

3. The connector according to claim 1, wherein the first bosses extend in a third direction perpendicular to the first and the second directions, the at least one second boss extending in the third direction and smaller in diameter than the at least one second through hole.

4. The connector according to claim 1, further comprising a shell coupled to the housing, the at least one second boss being integrally formed with the shell.

5. The connector according to claim 4, wherein the housing is made of plastic and the shell is made of metal.

6. The connector according to claim 1, wherein the board has a pair of third through holes, the connector having a pair of third bosses formed between the first bosses and the second boss in the second direction to be inserted into the third through holes, respectively.

7. The connector according to claim 6, wherein the housing is made of an insulating material and the shell is made of metal.

8. The connector according to claim 6, further comprising a shell coupled to the housing, the third bosses being integrally formed with the shell.

9. The connector according to claim 8, wherein at least one second boss is integrally formed with the shell.

10. A connector to be mounted to a board having a pair of first through holes and at least one second through hole, the connector comprising:

a housing;

a plurality of contacts arranged in a first direction and held by the housing;

a pair of supporting portions formed on the housing and protruding from the housing in a second direction perpendicular to the first direction;

a pair of first bosses protruding from the supporting portions to be inserted into the first through holes, respectively; and at least one second boss coupled to the housing to be inserted into the at least one second through hole, wherein the at least one second boss is smaller in diameter than the at least one second through hole.

11. The connector according to claim 10, wherein the first bosses are smaller in diameter than the first through holes.

12. The connector according to claim 10, wherein the first bosses extend in a third direction perpendicular to the first and the second directions and are smaller in diameter than the first through holes, the at least one second boss extending in the third direction.

13. The connector according to claim 10, further comprising a shell coupled to the housing, the at least one second boss being integrally formed with the shell.

14. The connector according to claim 13, wherein the housing is made of plastic and the shell is made of metal.

15. The connector according to claim 10, wherein the board has a pair of third through holes, the connector having a pair of third bosses formed between the first bosses and the second boss in the second direction to be inserted into the third through holes, respectively.

16. The connector according to claim 15, wherein the housing is made of an insulating material and the shell is made of metal.

17. The connector according to claim 15, further comprising a shell coupled to the housing, the third bosses being integrally formed with the shell.

18. The connector according to claim 17, wherein at least one second boss is integrally formed with the shell.

19. A connector to be mounted to a board having a pair of first through holes and at least one second through hole, the connector comprising:

a housing;

a plurality of contacts arranged in a first direction and held by the housing;

a pair of supporting portions formed on the housing and protruding from the housing in a second direction perpendicular to the first direction;

a pair of first bosses protruding from the supporting portions to be inserted into the first through holes, respectively; and at least one second boss coupled to the housing to be inserted into the at least one second through hole, wherein the first bosses extend in a third direction perpendicular to the first and the second directions and are smaller in diameter than the first through holes, the at least one second boss extending in the third direction and smaller in diameter than the at least one second through hole.

20. The connector according to claim 19, further comprising a shell coupled to the housing, the at least one second boss being integrally formed with the shell.

21. The connector according to claim 20, wherein the housing is made of plastic and the shell is made of metal.

22. The connector according to claim 19, wherein the board has a pair of third through holes, the connector having a pair of third bosses formed between the first bosses and the second boss in the second direction to be inserted into the third through holes, respectively.

23. The connector according to claim 22, wherein the housing is made of an insulating material and the shell is made of metal.

24. The connector according to claim 22, further comprising a shell coupled to the housing, the third bosses being integrally formed with the shell.

25. The connector according to claim 24, wherein at least one second boss is integrally formed with the shell.

* * * * *